US005713459A

United States Patent [19]

Beck et al.

[11] Patent Number: 5,713,459

[45] Date of Patent: Feb. 3, 1998

[54] ROLLER LATCHING AND RELEASE MECHANISM FOR ELECTRICAL SWITCHING APPARATUS

[75] Inventors: H. Richard Beck, Coraopolis; Richard E. White, Brighton Township; Kenneth M. Fischer, Union; Roger W. Helms, Beaver Falls, all of Pa.

[73] Assignee: Eaton Corporation, Cleveland, Ohio

[21] Appl. No.: 622,714

[22] Filed: Mar. 26, 1996

[51] Int. Cl.[6] ..... H01H 5/00

[52] U.S. Cl. ..... 200/401; 200/400

[58] Field of Search ..... 200/400, 401, 200/318, 323, 325; 335/9, 10

[56] References Cited

U.S. PATENT DOCUMENTS

| | | | |
|---|---|---|---|
| 2,866,872 | 12/1958 | Turner | 200/401 |
| 4,489,295 | 12/1984 | Altenhof, Jr. et al. | 335/20 |
| 4,491,814 | 1/1985 | Bellows | 200/401 |
| 4,887,057 | 12/1989 | Gula et al. | 335/190 |
| 5,120,921 | 6/1992 | Di Marco et al. | 200/401 |
| 5,200,724 | 4/1993 | Gula et al. | 335/166 |
| 5,341,191 | 8/1994 | Crookston et al. | 335/16 |

*Primary Examiner*—David J. Walczak
*Attorney, Agent, or Firm*—Martin J. Moran

[57] ABSTRACT

A circuit breaker includes a housing; separable contacts moveable between closed and open positions; an operating mechanism, for moving the separable contacts between the closed and open positions, having a first latched position and a second unlatched position corresponding to the open position of the separable contacts, and including a pair of cradles pivotally supported about a pivot axis within the housing to pivot in a first pivotal direction to the first position of the operating mechanism and a second pivotal direction to the second position of the operating mechanism; a handle mechanism for moving the cradles in the first pivotal direction; a latch mechanism for latching the operating mechanism in the first position thereof and for releasing the operating mechanism to the second position thereof, including a latch plate pivotally supported within the housing having two opposing elongated openings, a roller pin cross member generally parallel to the cradle pivot axis supported by the latch plate at each of the openings, and a spring mechanism for biasing the cross member with respect to the cradles; and a trip mechanism cooperating with the latch mechanism for releasing the operating mechanism to the second position thereof. An arcuate reset surface of the cradles independently engages a corresponding end of the cross member when the operating mechanism is moved toward the first position thereof. The cross member engages a linear latch surface of the cradles for latching the operating mechanism in the first position thereof.

18 Claims, 7 Drawing Sheets

FIG.5A
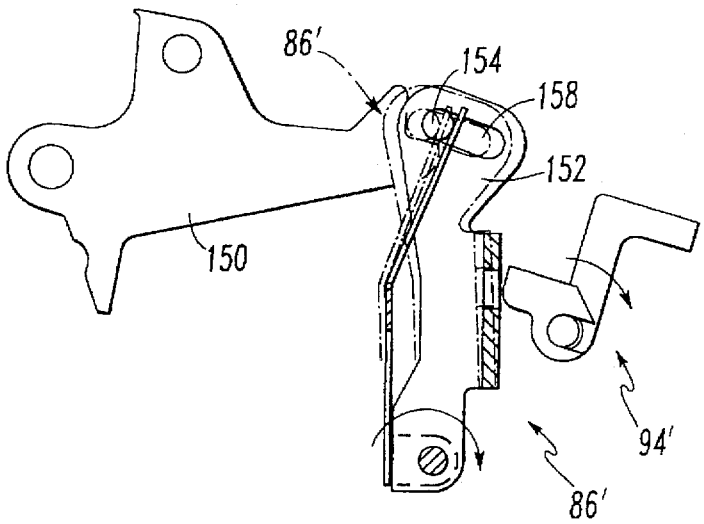
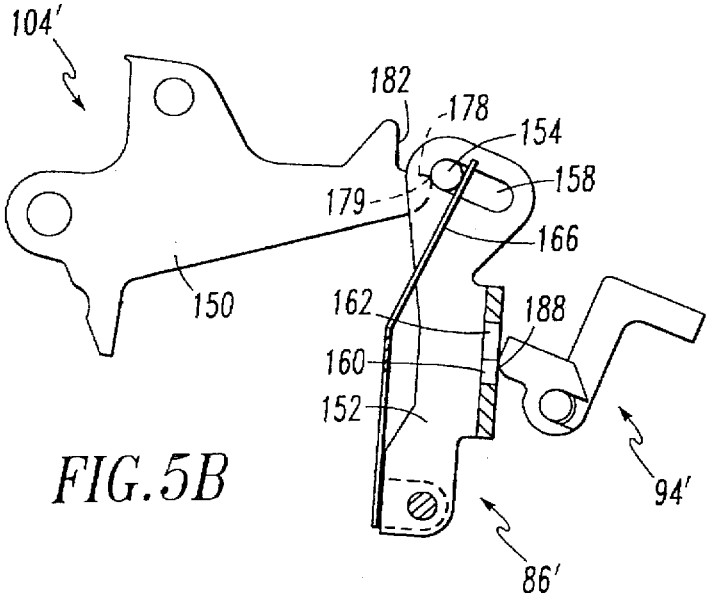
FIG.5B
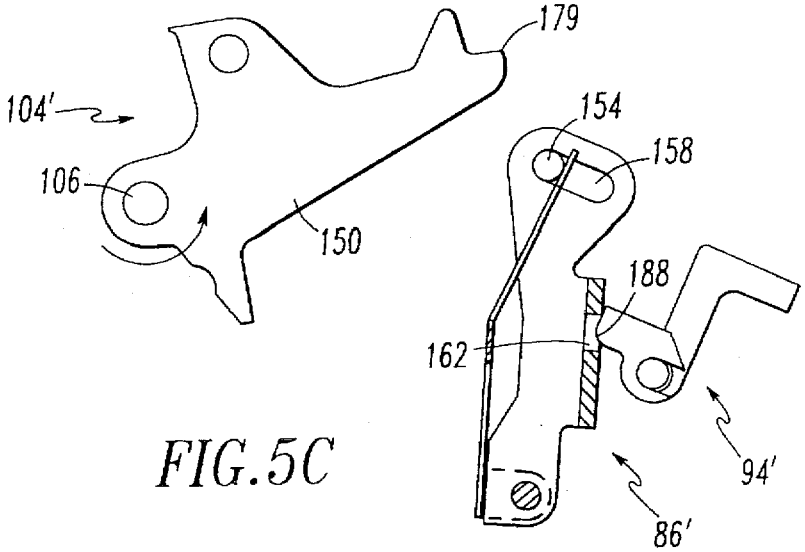
FIG.5C

FIG. 6A
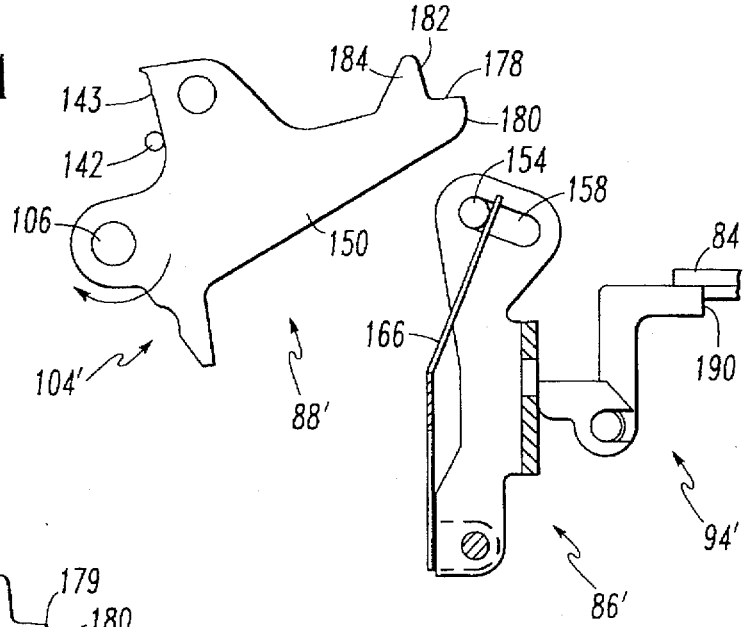
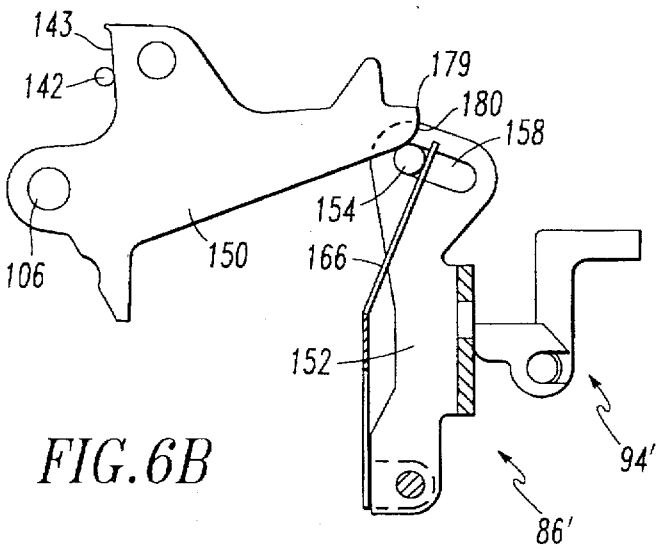
FIG. 6B
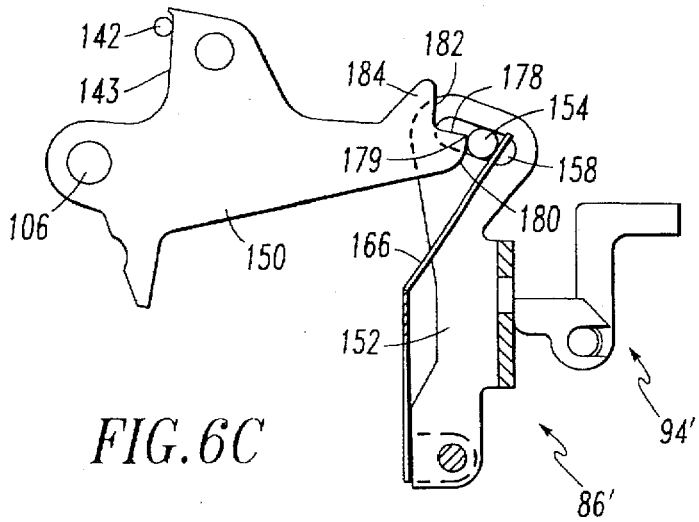
FIG. 6C

ROLLER LATCHING AND RELEASE MECHANISM FOR ELECTRICAL SWITCHING APPARATUS

BACKGROUND OF THE INVENTION

1. Field of the Invention

This invention is directed to an electrical switching apparatus and, more particularly, to an electrical circuit breaker including a cradle and a mechanism for latching and releasing the cradle.

2. Background Information

Electrical switching devices include, for example, circuit switching devices and circuit interrupters such as circuit breakers, contactors, motor starters and motor controllers. Circuit breakers are generally old and well known in the art. Examples of circuit breakers are disclosed in U.S. Pat. No. 4,887,057; 5,200,724; and 5,341,191. Such circuit breakers are used to protect electrical circuitry from damage due to an overcurrent condition, such as an overload condition or a relatively high level short circuit condition.

Molded case circuit breakers include a pair of separable contacts per phase which may be operated either manually by way of a handle disposed on the outside of the case or automatically in response to an overcurrent condition. The circuit breaker includes an operating mechanism which is designed to rapidly open and close the separable contacts, thereby preventing a moveable contact from stopping at any position which is intermediate a fully open or a fully closed position. The circuit breaker also includes a trip mechanism which senses overcurrent conditions for the automatic mode of operation. The trip mechanism causes a trigger mechanism to release the operating mechanism thereby tripping open the separable contacts.

The circuit breaker further includes a pivoting operating handle, which projects through an opening formed in the breaker housing, for manual operation. The handle may assume two or more positions during normal operation of the circuit breaker. In an on position, the handle is positioned at one end of its permissible travel. When the operating handle is moved to this position, and the breaker is not tripped, the contacts of the circuit breaker close, thereby allowing electrical current to flow from a current source to an associated electrical circuit. Near or at the opposite end of travel of the handle is an off position. When the handle is moved to that position, the contacts of the circuit breaker open, thereby preventing current from flowing through the circuit breaker.

In some circuit breakers, the handle automatically assumes an intermediate position, between the on and off positions, whenever the operating mechanism has tripped the circuit breaker and opened the contacts. Once the circuit breaker has been tripped, the electrical contacts cannot be reclosed until the operating handle is first moved to a reset position and then back to the on position. The reset position, which is at or beyond the off position, is at the opposite end of travel of the handle with respect to the on position. When the handle is moved to the reset position, the trip mechanism is reset in preparation for reclosure of the contacts when the handle is moved back to the on position.

Whenever the circuit breaker handle is in the on position, biasing springs connected to the handle provide a biasing force to a pivot pin. The pivot pin pivotally connects upper and lower links of a toggle mechanism. The lower toggle link is also pivotally connected to an arm carrier carrying the movable contact of one pole of the circuit breaker. The other poles are operated simultaneously by a crossbar. The upper toggle link is pivotally connected to a cradle which can be latched by a cradle latch mechanism which cooperates with the trip mechanism. When the circuit breaker is tripped, and the cradle is unlatched, the cradle rotates under the influence of the biasing springs. With the rotation of the cradle, the biasing springs also cause the collapse of the toggle mechanism. In turn, this causes the separation of the contacts.

After a trip, whenever the handle is rotated toward the reset position, a mechanism engages the cradle, which is in an unlatched position, and rotates the cradle toward a latched position. In turn, the cradle latching mechanism latches the cradle in its latched position. After this reset operation, the circuit breaker handle may be moved to the on position, thereby closing the contacts.

In some prior art circuit breakers having a dual cradle mechanism, precise manufacturing tolerances are necessary between the cradles and the latching mechanism in order to avoid misoperation of the latching mechanism such that only one of the cradles is properly latched.

Furthermore, with suitable moments, a force of about 300 pounds in the operating mechanism may be offset by a relatively small latch load of about 20 ounces in the trigger mechanism. As a result, even relatively small position variations between the cradles and the latching mechanism may cause significant changes in the direction of the operating force. This, in turn, reflects directly in the corresponding latch load and "shock-out" sensitivity. The corresponding latch load may be subject to a relatively large amount of variation due to the various positions assumed by components of the operating and latching mechanisms resulting from: (1) normal manufacturing tolerances; (2) production heat-treating operations; and (3) normal operating variations between latching operations.

For example, if the corresponding latch load is too small, the operating mechanism may shock-out to a trip position when the circuit breaker handle is moved to the on position. Also, manual "push-to-trip" operation of the circuit breaker may be adversely affected in the off position of the operation mechanism. In such off position, the force of the operating mechanism is further reduced because the mechanism spring of the operating mechanism is stretched less with respect to the on position. In turn, the corresponding reduced latch load may be insufficient to overcome the normal frictional forces within the operating and latching mechanisms. Conversely, relatively large latch loads may inhibit the automatic mode of operation during an overcurrent condition.

There is a need, therefore, for an improved mechanism which reliably maintains the latch state of a cradle mechanism.

There is a more particular need for an improved mechanism which reliably maintains the latch state of a dual cradle mechanism.

There is another more particular need for an improved mechanism which maintains a generally constant latch load.

There is also a need for an improved mechanism for latching a cradle mechanism.

There is a more particular need for an improved mechanism for latching a dual cradle mechanism.

SUMMARY OF THE INVENTION

These and other needs are satisfied by the invention which is directed to an electrical switching apparatus including a housing; separable contact means moveable between a closed position and an open position; operating means for moving the separable contact means between the closed position and the open position thereof having a first position and a second position corresponding to the open position of the separable contact means, and including cradle means pivotally supported about a pivot axis within the housing to pivot in a first pivotal direction to the first position of the operating means and a second pivotal direction to the second position of the operating means; means for moving the cradle means in the first pivotal direction; latch means for latching the operating means in the first position thereof and for releasing the operating means to the second position thereof, including a latch plate pivotally supported within the housing having two opposing openings, a cross member generally parallel to the pivot axis of the cradle means supported by the latch plate at each of the opposing openings, and means for biasing the cross member with respect to the cradle means, with a second surface of the cradle means engaging the cross member when the operating means is moved toward the first position thereof, and with the cross member engaging a first surface of the cradle means for latching the operating means in the first position thereof; and means cooperating with the latch means for releasing the operating means to the second position thereof in order to move the separable contact means to the open position thereof.

As another aspect of the invention, a circuit interrupter apparatus includes a housing; separable contacts moveable between a closed position and an open position; operating means for moving the separable contacts between the closed position and the open position thereof having a latched position and an unlatched position corresponding to the open position of the separable contacts, and including two cradle means each of which is pivotally supported within the housing about a pivot axis to pivot in a first pivotal direction to the latched position of the operating means and a second pivotal direction to the unlatched position of the operating means; means for moving each of the cradle means in the first pivotal direction; latch means for latching the operating means in the latched position thereof and for releasing the operating means to the unlatched position thereof, including a latch plate pivotally supported within the housing having two opposing openings, a cross member having two ends each of which is supported by the latch plate at a corresponding one of the opposing openings, and two spring means each of which biases a corresponding one of the ends of the cross member with respect to a corresponding one of the cradle means, with a second surface of each of the cradle means engaging a corresponding one of the ends of the cross member when the operating means is moved toward the latched position thereof, and with each of the ends of the cross member engaging a first surface of a corresponding one of the cradle means for latching the operating means in the latched position thereof; and trip means cooperating with the latch means for releasing the operating means to the unlatched position thereof in order to move the separable contacts to the open position thereof.

BRIEF DESCRIPTION OF THE DRAWINGS

A full understanding of the invention can be gained from the following description of the preferred embodiment when read in conjunction with the accompanying drawings in which:

FIGS. 5A–5C are side views, with some parts not shown for clarity, of one of the cradles and the roller latching and release mechanism of FIG. 1 in three successive positions during a trip operation;

FIGS. 6A–6D are side views, with some parts not shown for clarity, of one of the cradles and the roller latching and release mechanism of FIG. 1 in four successive positions during a reset operation;

DESCRIPTION OF THE PREFERRED EMBODIMENT

Figure 1:
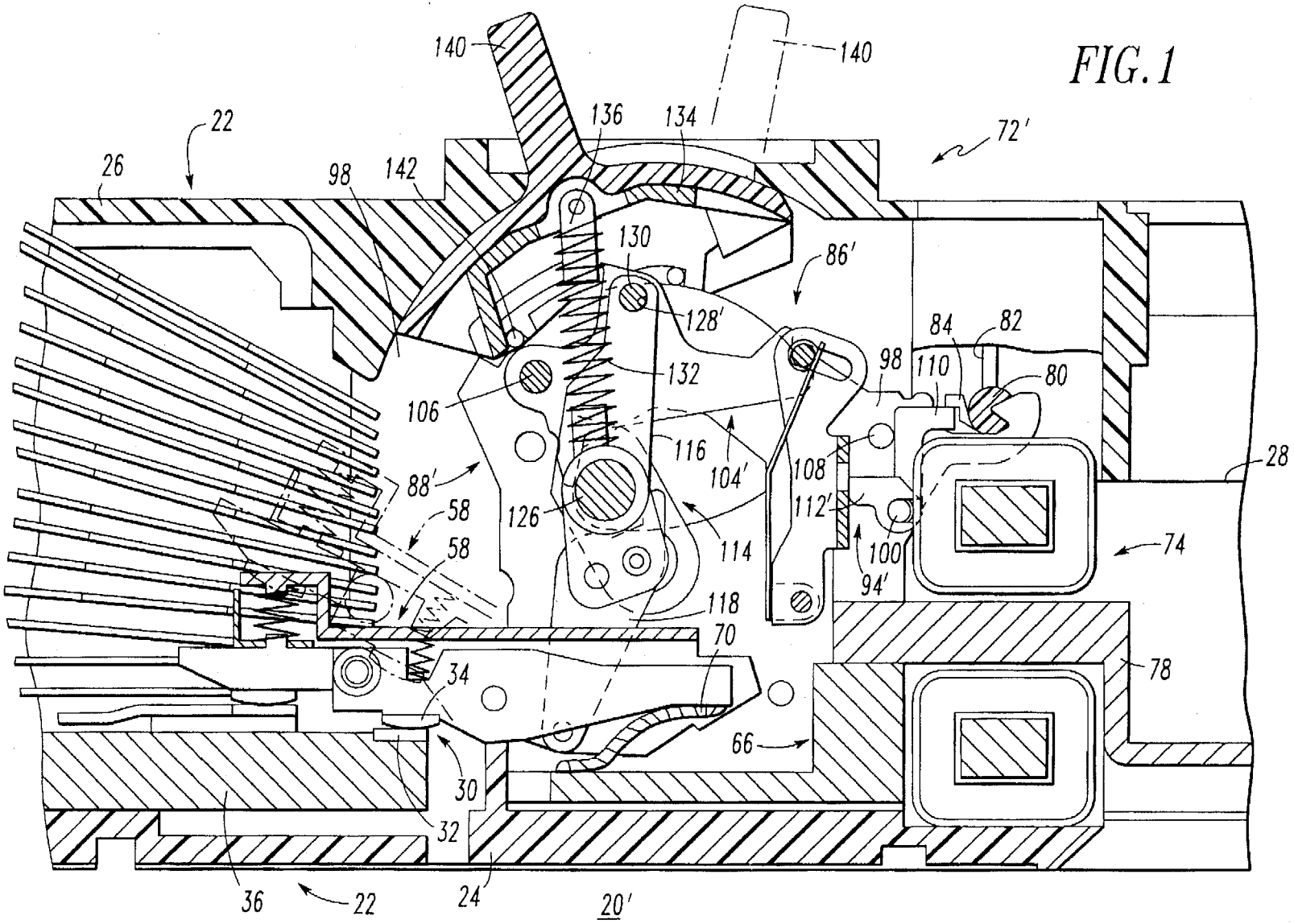
FIG. 1 is a vertical sectional view of a molded case circuit breaker in an on position incorporating a cradle mechanism and a roller latching and release mechanism in accordance with the present invention.

A typical example of a circuit breaker is disclosed in U.S. Pat. No. 5,341,191 which is herein incorporated by reference. The reference numerals up to and including 140 employed herein are consistent with U.S. No. Pat. No. 5,341,191. Referring to FIG. 1, a molded case three phase circuit breaker 20' comprises an insulated housing 22, formed from a molded base 24 and a molded cover 26, assembled at a parting line 28, although the principles of the present invention are applicable to various types of electrical switching devices and circuit interrupters.

The circuit breaker 20' also includes at least one pair of separable main contacts 30 per phase, provided within the housing 22, which includes a fixed main contact 32 and a movably mounted main contact 34. The fixed contact 32 is carried by a line side conductor 36, electrically connected to a line side terminal (not shown) for connection to an external circuit (not shown). A movably mounted main contact arm assembly 58 carries the movable contact 34 and is electrically connected to a load conductor 66 by way of a plurality of flexible shunts 70. A free end (not shown) of a load conductor 78 connected to the load conductor 66 acts as a load terminal for connection to an external load, such as a motor.

An electronic trip unit 72' includes, for each phase, a current transformer (CT) 74 for sensing load current. The CT 74 is disposed about the load conductor 78 and, in a manner well known in the art, detects current flowing through the separable contacts 30 in order to provide a signal to the trip unit 72' to trip the circuit breaker 20' under certain conditions, such as a predetermined overload condition. The trip unit 72' includes a trip bar 80 having an integrally formed extending trip lever 82 mechanically coupled to a flux shunt trip assembly (not shown) which cooperates to rotate the trip bar 80 clockwise (with respect to FIG. 1) during predetermined levels of overcurrent. Upon rotation of the trip bar 80, a latch lever 84, integrally formed on the trip bar 80, releases a latch lever trigger assembly 94'. In turn, the trigger assembly 94' releases a latch assembly 86' which, in turn, releases a circuit breaker operating mechanism 88' to the unlatched position thereof (as shown in FIG. 5C) in order to move the separable contacts 30 to the trip open position thereof, thereby allowing the circuit breaker 20' to trip.

Figure 2:
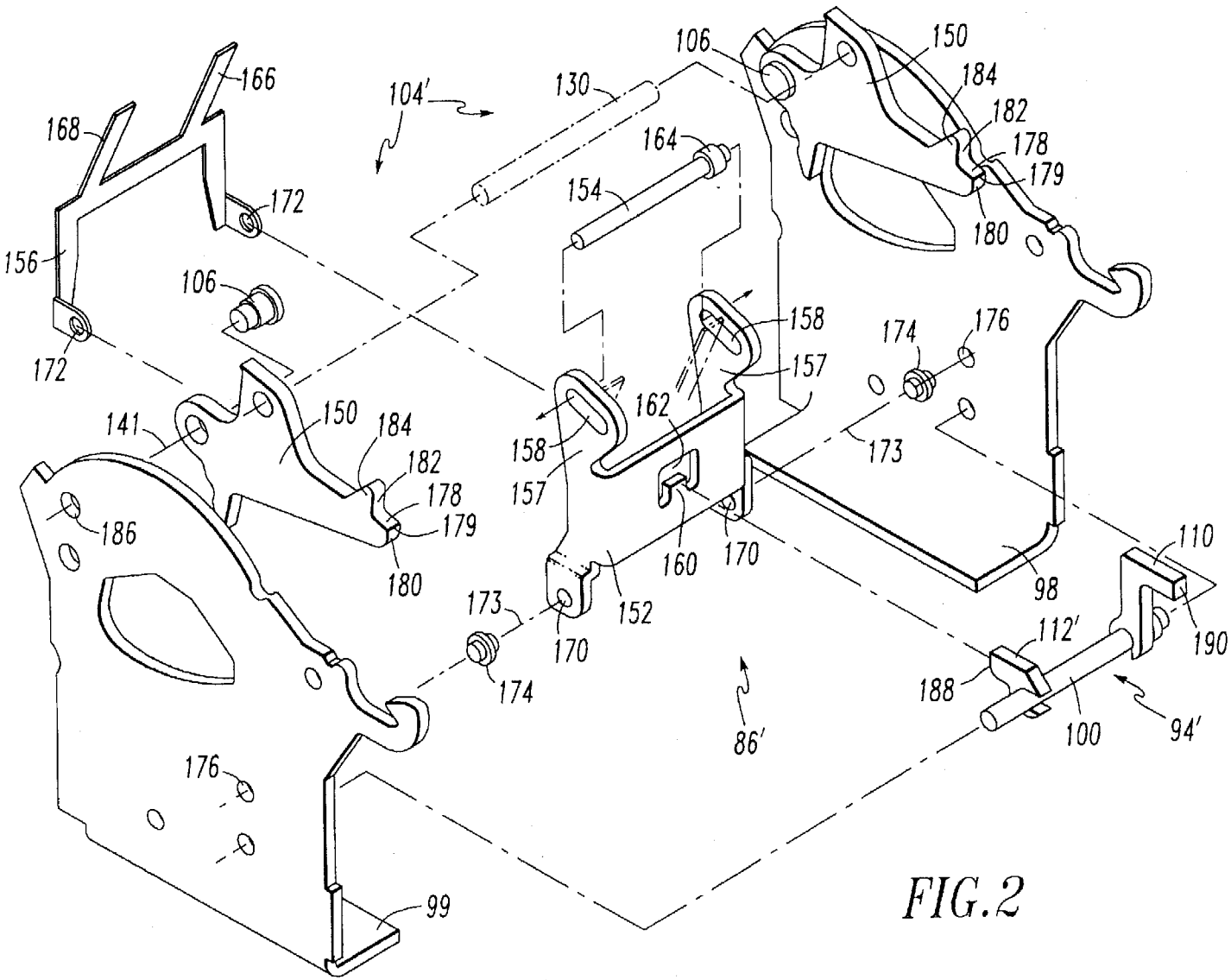
FIG. 2 is an exploded isometric view of the cradle mechanism incorporating dual cradles and the roller latching and release mechanism of FIG. 1.

The trigger assembly 94' is pivotally mounted to the two side plates 98,99. (side plate 99 is shown in FIG. 2) by a pin 100 and is biased in a counter-clockwise direction (with respect to FIG. 1) by a torsion spring (not shown). A stop pin 108 serves to limit rotation of the trigger assembly 94'. The trigger assembly 94' is integrally formed with an upper latch portion 110 and a lower latch portion 112'. The lower latch portion 112' is adapted to engage the latch assembly 86' as discussed below in connection with FIGS. 2–4 and 7A. The upper latch portion 110 is adapted to communicate with the latch lever 84 of the trip bar 80.

Figure 4:
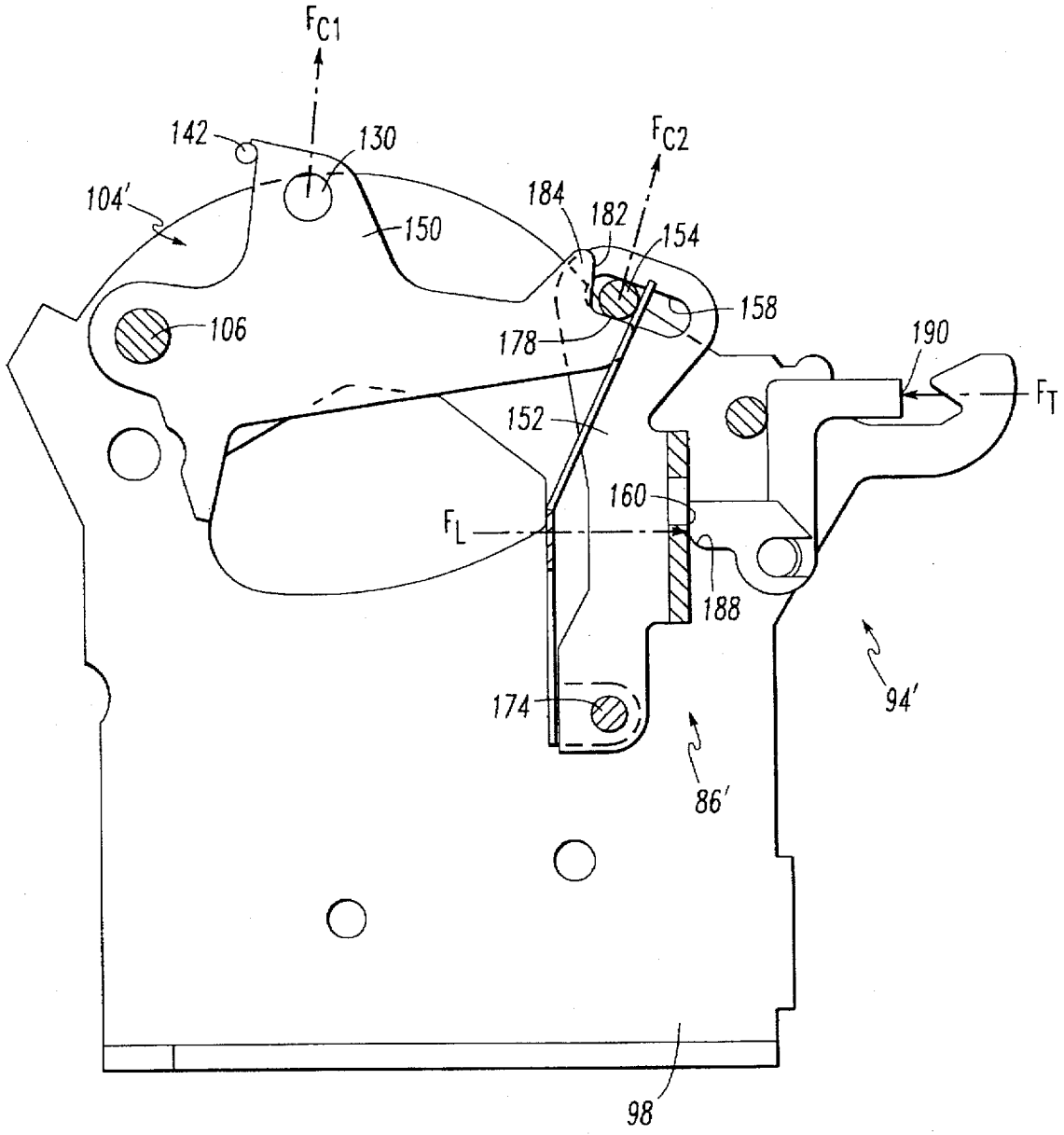
FIG. 4 is a side view, with some parts not shown for clarity, of one of the cradles and the roller latching and release mechanism of FIG. 1 in a latched position.

The latch assembly 86' latches the operating mechanism 88' during conditions when the circuit breaker 20' is in an on position (as shown in solid) and a non-trip off position (as partially shown in phantom line drawing). During an overcurrent condition, the trip unit 72' and, more specifically, the trip bar 80 releases the trigger assembly 94' of the trip unit 72' to allow the circuit breaker 20' to trip. The operating mechanism 88' has a latched position (as shown in FIG. 4) provided by the latch assembly 86', and an unlatched position (as shown in FIG. 5C) corresponding to the trip open position of the separable contacts 30.

The operating mechanism 88' moves the separable main contacts 30 between the closed and open positions thereof and, thus, facilitates opening and closing the separable contacts 30. The operating mechanism 88' includes a toggle assembly 114 which has a pair (only one is shown in FIG. 1) of upper toggle links 116 and a pair (only one is shown in FIG. 1) of lower or trip links 118. Each of the upper toggle links 116 receives a crossbar 126 and is provided with a hole 128' which allows it to be mechanically coupled to a cradle 104' by way of a pin 130. Operating springs 132 are connected between the crossbar 126 and a handle yoke assembly 134 by way of spring retainers 136.

Referring to FIGS. 1 and 2, the cradle 104' is formed from a pair of oppositely disposed cradle members 150. One end of each of the cradle members 150 is pivotally connected to a corresponding one of the side plates 98,99 by way of a pin 106. The cradle members 150, in cooperation with the latch assembly 86', allow the circuit breaker 20' to be tripped by way of the trigger assembly 94' of the trip unit 72'. More specifically, when the cradle members 150 are in the position shown in FIG. 1, the separable main contacts 30 are under the control of an extending operating handle 140, rigidly secured to the handle yoke 134, which enables the circuit breaker 20' to be placed in the off position (as partially shown in phantom line drawing). Similarly, the operating handle 140 may also be employed to place the circuit breaker 20' in the on position (as shown in solid).

Upon detection of an overcurrent, the trigger assembly 94', in response to the trip unit 72', releases the latch assembly 86' which, in turn, releases the cradle 104' to allow the main contacts 30 to be tripped under the influence of the operating springs 132. In order to reset the cradle 104', it is necessary to rotate the operating handle 140 toward the off position (as shown in phantom line drawing). The operating handle 140, in cooperation with the handle yoke 134 and a reset pin 142 driven by the yoke 134, allows each of the cradle members 150 to be moved clockwise (with respect to FIG. 1) and latched relative to the latch assembly 86'. During the reset operation, as shown in FIGS. 6A–6D, the reset pin 142 slides up the surface 143 of the cradle members 150 and pushes the cradle 104' toward the latched position. Once the cradle members 150 are latched, the operating handle 140 may be used to place the main contacts 30 in the on position.

The housing 22, separable contacts 30, operating mechanism 88' excluding the cradle 104', operating handle 140 and handle yoke 134, trip unit 72' excluding the trigger assembly 94', and trip bar 80 are disclosed in greater detail in U.S. Pat. No. 5,341,191. The present invention provides improvements disclosed herein in connection with the cradle 104' and cradle members 150, and the roller latching and release mechanism or latch assembly 86' which latches the cradle members 150 of the operating mechanism 88' in the latched position and which releases the cradle members 150 to the unlatched position.

Continuing to refer to FIG. 2, each of the cradle members 150 is pivotally supported by a corresponding one of the pins 106 about a pivot axis 141 to pivot in a clockwise direction (with respect to FIG. 2) to the latched position (as shown in FIG. 4) of the operating mechanism 88' of FIG. 1 and a counterclockwise direction to the unlatched position (as shown in FIG. 5C) of the operating mechanism 88'. The latch assembly 86' latches the cradle 104' of the operating mechanism 88' in the latched position thereof (as shown in FIG. 4) and releases (as shown in FIGS. 5B–5C) the cradle 104' to the unlatched position thereof (as shown in FIG. 5C).

Figure 7A:
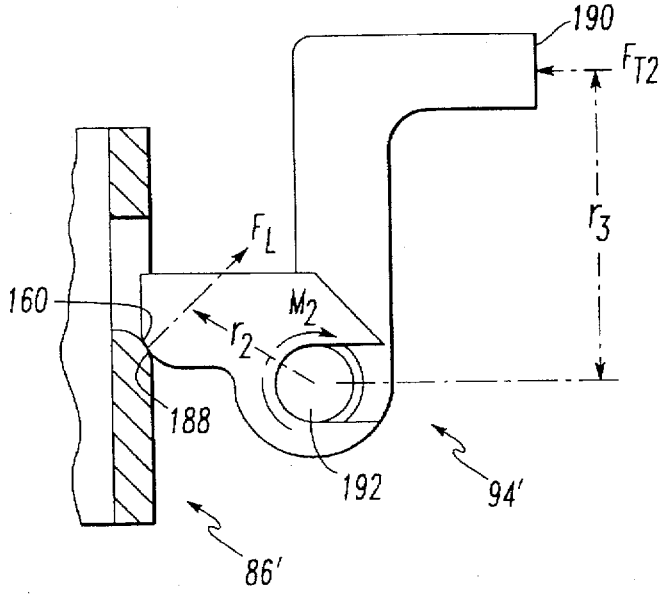
FIG. 7A is a side view of a latch surface of the roller latching and release mechanism of FIG. 1 engaging a surface of a trigger mechanism.

The latch assembly 86' includes a latch plate 152, a roller pin cross member 154, and a leaf-type bias spring member 156, although the invention is applicable to wire torsion bias springs (not shown) and other spring mechanisms for biasing the cross member 154 with respect to the cradle members 150. The latch plate 152 has opposing arms 157 with opposing openings forming elongated guide slots 158, each of which accepts an end of the cross member 154. The latch plate 152 also has an arcuate (as shown in FIG. 7A) latch surface 160, and a trigger clearance window or opening 162.

Figure 3:
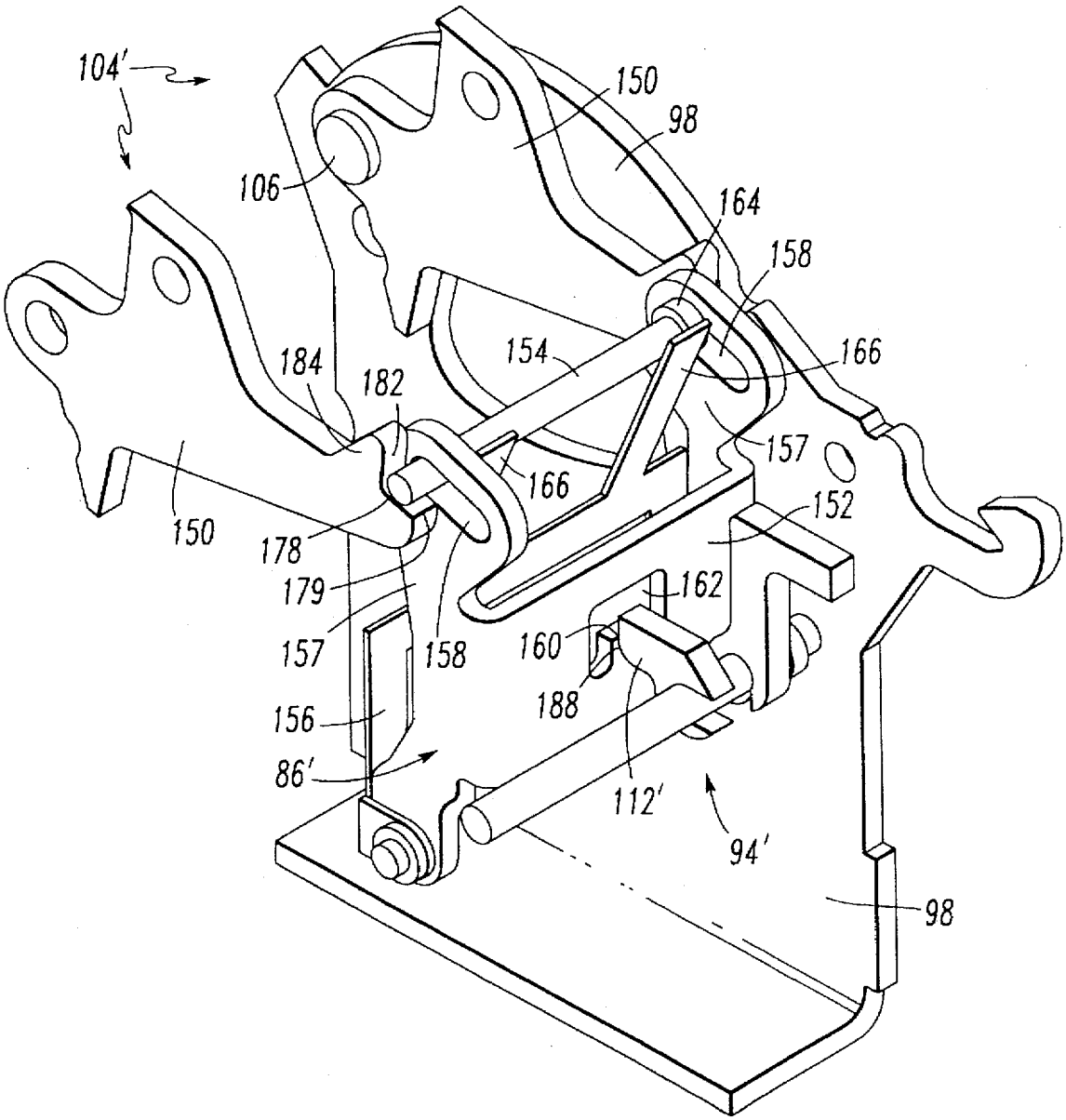
FIG. 3 is an isometric view, with some parts not shown for clarity, of the dual cradles and the roller latching and release mechanism of FIG. 1.

The exemplary cross member 154 is a roller pin having ends which roll in the guide slots 158. At about one of the ends of the cross member 154 is a shoulder 164. The single bias spring member 156 has two individual leaf-type spring portions 166, 168 for the two ends of the cross member 154, although the invention is applicable to separate bias spring members (not shown) for each of the ends of the cross member 154. When the latch assembly 86' is assembled (as shown in FIG. 3), the spring 166 captures the shoulder 164 between the spring 166 and the arm 157 (as shown in the upper right of FIG. 3) of the latch plate 152 obviating the need for additional retaining hardware. The shoulder 164 of the cross member 154 is retained between the side of the latch plate 152 and the spring 166. By employing a single shoulder 164, the cross member 154 is readily assembled into the latch plate 152. The assembled roller latch assembly 86' is assembled between the two side plates 98,99 (only one side plate 98 is shown in FIG. 3).

Continuing to refer to FIG. 2, the latch plate 152 is pivotally supported within the housing 22 of FIG. 1. Each of the arms 157 of the latch plate 152 has a pivot hole 170 opposite the guide slot 158 of the arm 157. Each of the sides of the spring member 156 has a pivot hole 172 which, with the pivot holes 170, form a pivot axis 173 for the latch plate 152. A pair of pivot pins 174 pivotally support the latch plate 152 and the spring member 156 about the pivot axis 173. Each of the pivot pins 174 is pivotally secured in a corresponding one of the mounting holes 176 of the side plates 98,99. The ends of the roller pin cross member 154 are supported by and roll in the opposing guide slots 158 of the latch plate 152 in order that the cross member 154 is generally parallel to the pivot axis 141 of the cradle members 150.

The spring member 156 biases the cross member 154 with respect to the cradle members 150 of the cradle 104' of FIG. 1. Each of the springs 166,168 biases a corresponding end of the cross member 154 with respect to the corresponding cradle member 150. In this manner, each of the springs 166,168 independently biases one end of the cross member 154 in the corresponding one of the opposing guide slots 158 of the latch plate 152, and each of the ends of the cross member 154 moves independently with respect to the other end thereof in a corresponding one of the opposing guide slots 158.

As discussed below in connection with FIGS. 4 and 6A–6D, each of the cradle members 150 independently engages a corresponding end of the cross member 154 in order to enter the latched position (as shown in FIG. 4) of the operating mechanism 88' of FIG. 1. Each of the cradle members 150 has a first or linear latch surface 178 for retention by the corresponding end of the cross member 154 in the latched position, an end 179 of the surface 178, a second or arcuate reset surface 180 for engaging the corresponding end of the cross member 154 in order to enter the latched position, and a third or limit surface 182 on a travel limit bump 184. The arcuate surface 180 of the cradle members 150 engages the corresponding end of the cross member 154 when the operating mechanism 88' is reset and moved toward the latched position thereof.

Referring to FIGS. 2 and 3, the interface between the roller latch assembly 86' and the links 116,118 of FIG. 1 is through the cradle members 150. Each of the cradle members 150 pivots in a hole 186 (as shown with the side plate 99 of FIG. 2) about the corresponding pin 106. The cross member 154 rides on the latch surface 178 when the corresponding cradle member 150 is latched, and is restrained in its motion by the limit surfaces 182 during the reset action when the operating mechanism 88' of FIG. 1 is moved from the unlatched toward the latched position thereof.

The interface between the roller latch assembly 86' and the trigger assembly 94' is achieved through sliding action between the arcuate latch surface 160 of the latch plate 152 and an arcuate surface 188 of the lower latch portion 112' of the trigger assembly 94'. The surface 190 of the upper latch portion 110 of the trigger assembly 94' is restrained and released by the latch lever 84 of the trip bar 80 of FIG. 1. As discussed below in connection with FIGS. 5A–5C, about when the roller latch assembly 86' releases the cradle members 150 to the unlatched position thereof (as shown in FIG. 5C), the latch plate 152 pivots in a clockwise direction generally opposite the counter-clockwise direction of the cradle member 150 (as shown in FIGS. 5A–5C). In turn, the arcuate surface 188 of the trigger assembly 94' may pass into the opening 162 of the latch plate 152 after the roller latch assembly 86' releases the cradle members 150 to the unlatched position thereof (as shown in FIG. 5C).

The opening 162 provides clearance in order that the relative rotations of the latch plate 152 and the trigger assembly 94' are not restrained. The rotation of the trigger assembly 94' is limited by other components such as the CT 74 of FIG. 1. With the opening 162, driving of the trigger assembly 94' into the CT 74 by the further rotation of the latch plate 152 is obviated. In other words, the opening 162 allows the latch plate 152 to rotate further without continuing to drive the trigger assembly 94'.

Referring to FIG. 4, some of the forces associated with one of the cradle members 150, the roller latch assembly 86' and the trigger assembly 94' are illustrated. Also referring to FIG. 1, the extension of the operating springs 132 is the source of a load which is transmitted to the pin 130 by the link 116 of the operating mechanism 88'. The force $F_{c1}$ is transmitted to the cradle member 150 from the pin 130. In turn, the force $F_{c2}$ of the cradle member 150 is transmitted from the linear latch surface 178 of the cradle member 150, through the end of the cross member 154 in the guide slot 158, to the latch plate 152 of the roller latch assembly 86'. The guide slot 158 of the latch plate 152 is an elongated slot with a central linear portion and two opposing ends. The force $F_{c2}$ is transmitted by the latch surface 178 of the cradle member 150, through the corresponding end of the cross member 154, to the linear portion of the elongated slot 158.

The limit surface 182 of the travel limit bump 184 limits movement of the cross member 154 away from the ends of the guide slot 158 and within the linear portion thereof in the latched position of the operating mechanism 88' of FIG. 1. The travel limit bump 184 of the cradle member 150 prevents the cross member 154 from moving to the extreme left (with respect to FIG. 4) of the guide slot 158 of the latch plate 152. This ensures that the force $F_{c2}$ transmitted to the latch plate 152 at the guide slot 158 by the cradle member 150 is always generally normal to the linear portion of the elongated guide slot 158, thereby providing a generally constant moment on the latch plate 152 about the pins 174.

By obviating contact of the end of the guide slot 158 by the cross member 154 in the latched position of the operating mechanism 88' of FIG. 1, the net forces are not divided into tangential and perpendicular components which would otherwise cause the net force direction to be unrepeatable and, hence, indeterminate. This adds certainty to the direction of the force in the roller latch assembly 86' and, hence, provides a generally constant moment on the latch member 152. Accordingly, maintaining the force direction normal to the elongated guide slot 158 provides a deterministic latch load which enhances the repeatability of the latch and release forces of the roller latch assembly 86'. The angles of the exemplary guide slots 158 and the latch surface 178 of the cradle member 150 provide a suitable force direction for the force $F_{c2}$ between the cradle member 150 and the roller latch assembly 86'.

The force $F_T$ is the latch force supplied by the latch lever 84 of the trip bar 80 of FIG. 1 to the surface 190 of the trigger assembly 94'. The force $F_L$ is transmitted from the roller latch assembly 86' to the trigger assembly 94'. The exemplary surfaces 160 and 188 are suitably shaped (e.g., as shown in FIG. 7A) to optimize the direction of the transmitted force $F_L$ to adjust the reset loads. For example, the surface 160 is coined or machined to present a radius to the corresponding radius of the surface 188, although the radius of the surface 160 may be formed by any suitable technique such as by piercing, bending or forming. As discussed below in connection with FIG. 7A, the moment on the trigger assembly 94' is preferably adjusted by such radii to provide a suitable moment for manual "push-to-trip" operation (not shown) in the circuit breaker off position in which the operating springs 132 of FIG. 1 are stretched less with respect to the on position. Furthermore, such radii obviate sharp corners which may dig into the opposing member and increase friction between the roller latch assembly 86' and the trigger assembly 94' during the trip operation.

Referring to FIGS. 5A–5C, the latch releasing or trip action of the roller latch assembly 86' is illustrated. Initially, the moments of the forces $F_L$ and $F_T$ of FIG. 4 are balanced. In response to the trip unit 72' of FIG. 1, the trip bar 80 of FIG. 1 releases the trigger assembly 94', thereby removing the force $F_T$. In turn, the forces between the cradle member 150 and the roller latch assembly 86' cause the assembly 86' to rotate clockwise (from the position shown in phantom line drawing in FIG. 5A to the position shown in solid). In turn, the trigger assembly 94' is driven clockwise (with respect to FIG. 5A) under the influence of the force $F_L$ with the clockwise rotation of the roller latch assembly 86'.

As the latch plate 152 pivots clockwise, the end of the cross member 154 rolls off the end 179 of the cradle member 150 in the following manner. The cross member 154, which is generally parallel to the pivot axis 141 (as shown in FIG. 2) of the cradle member 150, rolls toward the left edge (with respect to FIG. 5B) of the guide slot 158 in the latch plate 152. The cross member 154 simultaneously rolls along the linear surface 178 toward the right (with respect to FIG. 5B) release end 179 of the cradle member 150.

The clearance window 162 of the latch plate 152 may permit the trigger assembly 94' to pass therein (as shown in FIG. 5C). In this manner, the roller assembly 86' sufficiently rotates clockwise in order to allow the end of the cross member 154 to roll off the end 179 of cradle member 150 which is driven counterclockwise (with respect to FIG. 5C) by the operating mechanism 88' of FIG. 1 to the final "trip" position thereof (as shown in FIG. 5C). Preferably, a cross member such as the exemplary roller pin cross member 154 is employed to minimize any frictional forces between the cradle members 150 and the cross member 154, and between the cross member 154 and the guide slots 158, although the invention is applicable to other cross members which employ a sliding motion.

Figure 6D:
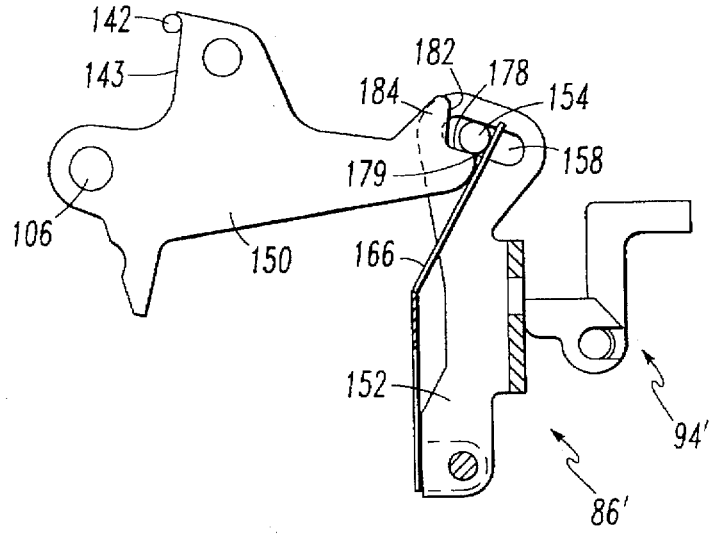

Referring to FIGS. 6A–6D, the reset or latching operation of the roller latch assembly 86' is illustrated. Immediately after the trip sequence discussed above in connection with FIGS. 5A–5C, the torsion spring (not shown) of the trigger assembly 94' causes the trigger assembly 94' and, hence, the roller latch assembly 86' to resume their original positions (as shown in FIG. 6A). The roller latch assembly 86' and the trigger assembly 94' remain fixed for the remainder of the reset operation due to the surface 190 of the trigger assembly 94' engaging the latch lever 84 of the trip bar 80 of FIG. 1.

As the operating mechanism 88', the cradle 104' and its cradle members 150 are driven to its latched position under the influence of the operating handle 140, the handle yoke 134 and the reset pin 142, as discussed above in connection with FIG. 1, the cradle members 150 are driven clockwise (with respect to FIG. 6A) toward the roller latch assembly 86'. The spring 166 biases the corresponding end of the cross member 154 toward the left (with respect to FIG. 6A) within the guide slot 158. As the cradle member 150 rotates clockwise, it engages (as shown in FIG. 6B) the end of the cross member 154. In turn, the arcuate surface 180 of the cradle member 150 pushes (as shown in FIGS. 6B–6C) the end of the cross member 154 along the guide slot 158 of the latch plate 152 against the restoring force of the bias spring 166. This moves the end of the cross member 154 toward the right (with respect to FIGS. 6B–6C) within the guide slot 158. As the cradle member 150 "rocks," the cross member 154 is pushed further into the guide slot 158 and is ultimately pushed off the end 179 of the cradle member 150 (as shown in FIGS. 6C–6D). The cross member 154 generally moves parallel to the pivot axis 141 (as shown in FIG. 2) of the cradle members 150, from the second surface 180 and off the end 179 of each of the cradle members 150, although each of the ends of the cross member 154 moves independently.

As the end of the cross member 154 moves off the end 179 of the cradle member 150, the restoring force of the bias spring 166 causes the end of the cross member 154 to snap leftward (with respect to FIGS. 6C–6D) and back into position above the latch surface 178 of the cradle member 150. There, the end of the cross member 154 contacts the surface 182 of the travel limit bump 184 which limits leftward (with respect to FIGS. 6C–6D) movement of the end of the cross member 154. Excess rotation (i.e., "reset overtravel") of the cradle member 150 during the reset operation causes the cross member 154 to slide and/or roll up along the right (with respect to FIG. 6B–6D) edge of the travel limit bump surface 182. When forces induced by the handle 140 of FIG. 1 are relaxed after the reset operation, the end of the cross member 154 returns to its position against the cradle member latch surface 178 within the linear portion of the guide slot 158. As shown in FIGS. 4 and 6D, the roller latch assembly 86' is in the original, latched position in which both ends of the cross member 154 engage the linear surface 178 of the corresponding cradle member 150.

Figure 7B:
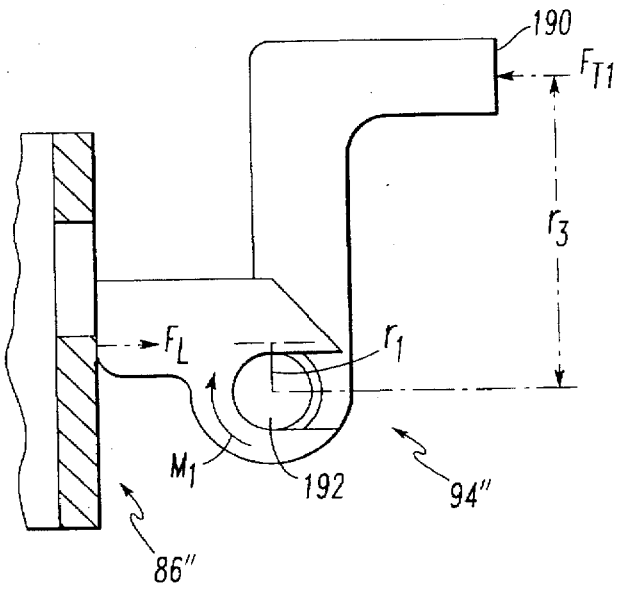
FIG. 7B is a side view of a latch surface of a roller latching and release mechanism engaging a surface of a trigger mechanism.

FIG. 7A illustrates the force $F_L$ between the arcuate latch surface 160 of the roller latching and release assembly 86' and the arcuate surface 188 of the trigger assembly 94' and, also, illustrates the opposing latch force $F_{T2}$ between the latch lever 84 of the trip bar 80 of FIG. 1 and the surface 190 of the trigger assembly 94'. The moment ($M_{22}=F_L \times r_2$) on the trigger assembly 94' may be adjusted to be increased or decreased by the selection of the radii of the surfaces 160,188. For example, as shown in FIG. 7B, a relatively small moment ($M_1=F_L \times r_1$ ) is provided by corresponding linear surfaces of assemblies 86", 94". This corresponds to a smaller opposing latch force $F_{T1}$. The moment $M_1$ may be increased (decreased) by increasing (decreasing) the radius, from $r_1$ to $r_2$, between the force $F_L$ and the pivot axis 192 of the trigger assembly 94'. By adjusting the radii, the moment is adjusted and, hence, the latch load on the trip bar 80 is suitably adjusted up or down as appropriate.

During the reset operation described above in connection with FIG. 6A–6D, the cross member 154 moves independently in each of the two guide slots 158 due to the two independent bias springs 166, 168 (as shown in FIGS. 2 and 3). Each of the bias springs 166,168 acts at one end of the cross member 154. In this manner, the independent reset motion of the two cradle members 150 with the exemplary roller pin cross-member 154 reduces the friction caused by any misalignment between the dual cradle members 150 and the roller latch assembly 86'.

The exemplary roller latch assembly 86' improves component positioning during the reset operation. By minimizing the variation of the positions of the components between reset operations, the change in reset force directions is reduced. This provides a generally consistent reset load. Furthermore, the roller latch assembly 86' provides a smoother tripping and reset action due to the reduced friction between the two cradle members 150 and the exemplary roller pin cross member 154. This provides a more positive reset operation.

With respect to prior art torsion springs, the exemplary single piece bias spring 156 provides additional space for an increased copper cross section in the mechanism pole (e.g., in the conductors 66,78 of FIG. 1), thereby reducing resistance and temperature rise in the circuit breaker 20'. Furthermore, the exemplary bias spring 156 may be formed by stamping which reduces cost. The exemplary roller latch assembly 86' also reduces cost by eliminating relatively complex geometries employed by prior art latch assemblies.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit interrupter apparatus comprising:

a housing;

separable contacts moveable between a closed position and an open position;

operating means for moving said separable contacts between the closed position and the open position thereof, said operating means having a latched position and an unlatched position corresponding to the open position of said separable contacts, said operating means including:

two cradle means each of which has a first surface and a second surface, each of said cradle means pivotally supported within said housing about a pivot axis to pivot in a first pivotal direction to the latched position of said operating means and a second pivotal direction to the unlatched position of said operating means;

means for moving each of said cradle means in the first pivotal direction;

latch means for latching said operating means in the latched position thereof and for releasing said operating means to the unlatched position thereof, said latch means including:

a latch plate pivotally supported within said housing, said latch plate having two opposing openings, a cross member having two ends each of which is supported by said latch plate at a corresponding one of the opposing openings, and two spring means each of which biases a corresponding one of the ends of said cross member with respect to a corresponding one of said cradle means, the second surface of each of said cradle means engaging a corresponding one of the ends of said cross member when said operating means is moved toward the latched position thereof, each of the ends of said cross member engaging the first surface of a corresponding one of said cradle means for latching said operating means in the latched position thereof; and trip means cooperating with said latch means for releasing said operating means to the unlatched position thereof in order to move said separable contacts to the open position thereof.

2. The apparatus as recited in claim, 1 wherein each of the opposing, openings of said latch plate is an elongated slot; wherein said cross member is a roller pin; and wherein each of the ends of the roller pin rolls in a corresponding one of the elongated slots.

3. The apparatus as recited in claim 2 wherein; about when said latch means releases said operating means to the unlatched position thereof, said latch plate pivots in a pivotal direction generally opposite the second pivotal direction of each of said cradle means, the roller pin generally parallel to the pivot axis of each of said cradle means, rolling in a first lateral direction with respect to the elongated slot and rolling in a second lateral direction with respect to the first surface of each of said cradle means.

4. The apparatus as recited in claim 3 wherein each of said cradle means has an end with the first surface of said each of said cradle means at about said end; and wherein said latch plate pivots in order that each of the ends of the roller pin rolls off the end of the corresponding one of said cradle means.

5. The apparatus as recited in claim 1 wherein one of the ends of said cross member has a shoulder; wherein said latch plate has an arm for each of the opposing openings; and wherein the shoulder of said cross member rests between one of the arms and the corresponding one of said spring means.

6. The apparatus as recited in claim 1 wherein each of said cradle means also has a third surface for limiting movement of said cross member during movement of said operating means from the unlatched position toward the latched position thereof.

7. The apparatus as recited in claim 6 wherein each of the opposing openings of said latch plate is a slot with a linear portion and two ends; wherein the third surface of each of said cradle means limits movement of said cross member away from the ends and within the linear portion of the slot in the latched position of said operating means; wherein each of said cradle means produces a force on said latch means, the force transmitted by the first surface of each of said cradle means, through a corresponding one of the ends of said cross member to the linear portion of the corresponding slot, the force transmitted generally normal to the linear portion thereby providing a generally constant moment on said latch plate.

8. The apparatus as recited in claim 1 wherein said latch plate has an arcuate surface; wherein said trip means has an arcuate surface which engages the arcuate surface of said latch plate.

9. The apparatus as recited in claim 1 wherein, about when said latch means releases said operating means to the unlatched position thereof, said latch plate pivots in a pivotal direction generally opposite the second pivotal direction of each of said cradle means; wherein said latch plate has a third opening therein; and wherein said trip means includes trigger means which passes into the third opening of said latch plate after said latch means releases said operating means to the unlatched position thereof.

10. The apparatus as recited in claim 1 wherein each of the opposing openings of said latch plate is an elongated slot; wherein each of said spring means biases said cross member in a first lateral direction within the elongated slot; and wherein said means for moving moves each of said cradle means in a latching operation during which the second surface of each of said cradle means engages and moves said cross member in a second lateral direction within the elongated slot.

11. The apparatus as recited in claim 10 wherein said cross member is a roller pin; wherein the second surface of each of said cradle means is at about the end of said each of said cradle means; wherein, during said latching operation, said latch means is generally fixed and each of said cradle means pivots in the first pivotal direction; and wherein the roller pin is moved generally parallel to the pivot axis of each of said cradle means by each of said cradle means, in the second lateral direction, from the second surface and off the end of each of said cradle means.

12. The apparatus as recited in claim 11 wherein the roller pin is moved by each of said spring means, in the first lateral direction, to about the first surface of each of said cradle means.

13. The apparatus as recited in claim 12 wherein each of said cradle means also has a third surface which limits movement of the roller pin in the first lateral direction.

14. The apparatus as recited in claim 10 wherein said cross member is a roller pin; and wherein, during said latching operation, each of the ends of the roller pin moves from the second surface of the corresponding one of said cradle means to the first surface of the corresponding one of said cradle means.

15. The apparatus as recited in claim 11 wherein each of the ends of said cross member moves independently with respect to the other end thereof in a corresponding one of the opposing openings of said latch plate.

16. The apparatus as recited in claim 11 wherein each of said spring means independently biases one of the ends of said cross member in the corresponding one of the opposing openings of said latch plate.

17. The apparatus as recited in claim 1 wherein each of said cradle means independently engages a corresponding one off the ends of said cross member.

18. An electrical switching apparatus comprising:

a housing;

separable contact means moveable between a closed position and an open position;

operating means for moving said separable contact means between the closed position and the open position thereof, said operating means having a first position and a second position corresponding to the open position of said separable contact means, said operating means including:

cradle means having a first surface and a second surface, said cradle means pivotally supported about a pivot axis within said housing to pivot in a first pivotal direction to the first position of said operating means and a second pivotal direction to the second position of said operating means;

means for moving said cradle means in the first pivotal direction;

latch means for latching said operating means in the first position thereof and for releasing said operating means to the second position thereof, said latch means including:

a latch plate pivotally supported within said housing, said latch plate having two opposing openings;

a cross member generally parallel to the pivot axis of said cradle means supported by said latch plate at each of the opposing openings;

means for biasing said cross member with respect to said cradle means, the second surface of said cradle means engaging said cross member when said operating means is moved toward the first position thereof, said cross member engaging the first surface of said cradle means for latching said operating means in the first position thereof;

means cooperating with said latch means for releasing said operating means to the second position thereof in order to move said separable contact means to the open position thereof; and wherein each of the opposed openings of said latch plate is an elongated slot; and wherein said cross member is a roller pin which rolls in each of the elongated slots.

* * * * *